US008453265B2

(12) United States Patent
Forte et al.

(10) Patent No.: US 8,453,265 B2
(45) Date of Patent: Jun. 4, 2013

(54) APPAREL ATTACHABLE DETACHABLE DISPLAY FRAME

(76) Inventors: Michael A. Forte, Miami Beach, FL (US); Joseph M. Geraci, Singer Island, FL (US)

( * ) Notice: Subject to any disclaimer, the term of this patent is extended or adjusted under 35 U.S.C. 154(b) by 0 days.

(21) Appl. No.: 13/291,283

(22) Filed: Nov. 8, 2011

(65) Prior Publication Data

US 2012/0137399 A1 Jun. 7, 2012

Related U.S. Application Data

(63) Continuation-in-part of application No. 12/172,916, filed on Jul. 14, 2008, now abandoned.

(51) Int. Cl.
*A41D 13/00* (2006.01)

(52) U.S. Cl.
USPC ..... 2/115; 2/247; 40/586

(58) Field of Classification Search
USPC ..... 2/69, 247, 115, 118, 119, 102, 108, 2/85, 93, 94, 246, 248, 250, 252; 40/586
See application file for complete search history.

(56) References Cited

U.S. PATENT DOCUMENTS 1,436,854 A * 11/1922 Brady ..... 40/586
1,467,680 A * 9/1923 Oda ..... 40/725
3,438,062 A * 4/1969 Curzon ..... 2/247
4,266,300 A * 5/1981 Partridge ..... 2/247
4,386,437 A * 6/1983 Fosher ..... 2/209.13
4,516,337 A * 5/1985 Adamik ..... 36/136
4,924,613 A * 5/1990 Levin ..... 40/586
4,992,353 A * 2/1991 Rodakis et al. ..... 430/213
5,086,516 A * 2/1992 Baxter et al. ..... 2/108
5,452,479 A * 9/1995 Mostert ..... 2/195.1
5,548,847 A * 8/1996 Spicijaric ..... 2/209.13
5,943,698 A * 8/1999 Blanks, I ..... 2/69
5,953,757 A * 9/1999 Blanks, I ..... 2/243.1
5,958,525 A * 9/1999 Green et al. ..... 428/14
5,960,476 A * 10/1999 Danzy ..... 2/115
6,023,790 A * 2/2000 Schwartz ..... 2/247
6,154,992 A * 12/2000 Lee ..... 40/329
6,751,805 B1 * 6/2004 Austion ..... 2/94
6,789,340 B2 * 9/2004 Chasnoff ..... 40/661
6,820,281 B2 * 11/2004 Mariland et al. ..... 2/115
7,093,305 B2 * 8/2006 Reilly et al. ..... 2/209.13
7,571,495 B2 * 8/2009 Emeth ..... 2/244
2009/0158490 A1 * 6/2009 White et al. ..... 2/69

* cited by examiner

*Primary Examiner* — Richale Quinn
(74) *Attorney, Agent, or Firm* — Michael I. Kroll

(57) ABSTRACT

A garment display frame that provides apparel with at least one display frame releasably incorporated into said apparel where the apparel has a part of a mating pair of fasteners and the display frame has the other part. The display frame has a border mounted to the edge of the display frame with a plastic transparent or translucent receptacle bound thereby having a pocket so that the user can insert a visual display of their choosing therein. Also, the apparel display frame has a receptacle that can be incorporated into any garment so that a user can selectively insert any picture, image, message, graphic or artwork as desired.

9 Claims, 16 Drawing Sheets

APPAREL ATTACHABLE DETACHABLE DISPLAY FRAME

RELATED APPLICATIONS

This application is a Continuation-In-Part of U.S. patent application Ser. No. 12/172,916, having a filing date 14 Jul. 2008 now abandoned.

Please incorporate by reference all information in said patent application into this continuation-in-part application.

BACKGROUND OF THE INVENTION

1. Field of the Invention

The present invention relates generally to displays and, more specifically, to a garment display frame that provides apparel with at least one display frame releasably incorporated into said apparel where the apparel has one part of a mating pair of fasteners and the display frame has the other part. The display frame has a border mounted to the edge of the display frame with a plastic transparent or translucent receptacle bound thereby having a pocket so that the user can insert a visual display of their choosing therein.

The apparel display frame has a receptacle that can be incorporated into any garment so that a user can selectively insert any picture, image, message, graphic or artwork as desired. The garment has a first part of a mating fastener while the display frame has the second part incorporated therein whereby the display frame can be removed prior to washing the garment. As illustrated, the garment has at least one display frame of any shape thereon that can occur on any part of the garment forming an integral part therewith.

2. Description of the Prior Art

There are other pocket-like devices designed for display. Typical of these is U.S. Pat. No. 2,527,258 issued to Kahn on Oct. 24, 1950.

Another patent was issued to Leichter on Mar. 18, 1952 as U.S. Pat. No. 2,589,409. Yet another U.S. Pat. No. 2,647,261 was issued to Rassner on Aug. 4, 1953 and still yet another was issued on Aug. 10, 1954 to Chrisman as U.S. Pat. No. 2,685,690.

Another patent was issued to Eilen on Jun. 6, 1961 as U.S. Pat. No. 2,986,743. Yet another U.S. Pat. No. 3,484,974 was issued to Culmone on Dec. 23, 1969. Another was issued to Slezak on Apr. 3, 1973 as U.S. Pat. No. 3,724,101 and still yet another was issued on Mar. 24, 1987 to White as U.S. Pat. No. 4,651,355.

Another patent was issued to Zevchak on Oct. 8, 1991 as U.S. Pat. No. 5,054,127. Yet another U.S. Pat. No. 6,035,449 was issued to Galler et al. on Mar. 14, 2000. Another was issued to Power on Jul. 12, 1994 as U.K. Patent No. GB2278534 and still yet another was issued on May 25, 1998 to Manfre as Canada Patent No. 2,219,826.

U.S. Pat. No. 2,527,258

Inventor: James M. Kahn

Issued: Oct. 24, 1950

In a garment of the class described, a body portion, a co-planar body panel separably secured thereto and a waist band portion. A lower marginal edge portion of said panel extending, beneath said waist band portion and being thereat separably secured thereto.

U.S. Pat. No. 2,589,409

Inventor: William J. Leichter

Issued: Mar. 18, 1952

In a device of the class described, a blouse including a back panel provided with a rectangular opening therein, a frame disposed on the inner face of the back panel in surrounding relation to said opening therein, said frame including three pieces of material folded upon themselves to provide channel members and secured to the rear panel adjacent the bottom and side edges of said opening, and a fourth piece of material integral with the back panel folded upon itself to provide a channel member and extending along the upper edge of said opening, and an ornamental panel removably disposed within said frame.

U.S. Pat. No. 2,647,261

Inventor: Henry Rassner

Issued: Aug. 4, 1953

An improved sports shirt consisting of a permanently attached front, back, laterally extending sleeves, and a yoke member extending across the top portion of the back thereof which has at least a free lower depending edge, a series of spaced fastening members mounted on the underside of said yoke along said free edge thereof, said shirt having spaced fastening members mounted on the back thereof adjacent each of the sleeves, said shirt having spaced fastening members mounted adjacent the lower edge of said back, and a detachable insignia carrying member having a plurality of fastening members disposed at spaced intervals so as to engage cooperatively the fastening members of said shirt to mount detachably the same thereover.

U.S. Pat. No. 2,685,690

Inventor: Charles M. Chrisman

Issued: Aug. 10, 1954

In combination, a body garment, spaced rows of female snap fastening members attached to the garment, a panel of sheet material having borders of stiffened material spaced substantially the same distance apart as said rows, each border having a plurality of rows of apertures with a plurality of apertures in each row, and male fastening members engageable with the female fastening members, each of the male fastening members extending through one of said apertures in said panel and cooperating with a female fastening member, said fastening members securing said panel to said garment.

U.S. Pat. No. 2,986,743

Inventor: Joseph G. Eilen

Issued: Jun. 6, 1961

A garment comprising a body provided with a pocket-forming panel marginally secured thereto and extending in flat relation over the body with one face presented outwardly, a U-shaped strip disposed flatwise upon the outwardly presented face of the panel, said strip being secured at its outer margins to said body and to the margins of the pocket-forming panel in the provision of an open-ended auxiliary pocket having an enlarged aperture, a transparent window disposed in said auxiliary pocket in overlying relation to the aperture, and cooperating closure means on said U-shaped strip and pocket-forming panel for retaining the window in said auxiliary pocket.

U.S. Pat. No. 3,484,974

Inventor: Louis W. Culmone

Issued: Dec. 23, 1969

In combination with a jersey, an elongated strip having an outer surface formed of a first separable fastening member, said strip being permanently secured to said clothing, a plurality of letters forming an individual's name being separably secured to said strip, said letters each having a rear surface formed of a second separable fastening member, one of said separable fastening members comprising a plurality of loop elements and the other of said separable fastening members comprising a plurality of resiliently deformable hook-shaped members adapted to engage said loop elements, whereby said letters forming said name are secured to said strip by the separable engagement of said hooks with said loop elements.

U.S. Pat. No. 3,724,101

Inventor: Imogene F. Slezak

Issued: Apr. 3, 1973

A cape for a teacher to wear having 21 colored patch pockets on the front with detachable patches thereon displaying the consonants of the alphabet. A vertical row of 10 patches down the center include long vowels in black on circles of white felt and short vowels on triangles of white felt. The patches having consonants and vowels may be removed from the garment and placed on a display board for spelling out words. The consonant patches are rectangular or square in shape. The pockets carry items or cards having first letters corresponding to the consonant on the patch.

U.S. Pat. No. 4,651,355

Inventor: McNeil White

Issued: Mar. 24, 1987

A replaceable patch type pocket with fasteners at the corners of the pocket for attaching the pocket to the surface of a garment.

U.S. Pat. No. 5,054,127

Inventor: Eric Scott Zevchak

Issued: Oct. 8, 1991

A system of interchangeable pockets. The system generally comprises a plurality of base pads attached to articles of clothing and a plurality of interchangeable pockets. The pockets of the system are made interchangeable by attaching a first type of fastening material to the back of each pocket and a corresponding second type of fastening material to each base pad.

U.S. Pat. No. 6,035,449

Inventor: Raymond R. Galler et al.

Issued: Mar. 14, 2000

A pocket using opposing magnetic strips that may be repeatedly attached to and detached from either the inside or the outside of an article having a thin sheet wall (such as a piece of clothing, a hat, a portable bag, or decorative articles like holiday stockings). The detachable pocket includes a pair of fabric patches including strip magnets that are sewn into a hem around most of the periphery of each patch, forming a backless pouch. Each magnetized pouch so formed can thus be placed on opposing sides of the article and thereby form a detachable pouch on the inside and on the outside of the article. An alternative embodiment has a pocket pouch only on the outside of the article with a U-shaped magnetic member holding the outside pouch from the inside of the article. The outside pouch can be decorated in accordance with a seasonal theme permitting ordinary clothing and like articles to be decorated according to the holiday season.

U.K. Patent Number GB2 278 534

Inventor: Martin Sean Power

Issued: Jul. 12, 1994

A joint protecting pad is detachably secured to an article of clothing by, for example, buttons, zips or poppers. In the embodiment shown the pad is permanently secured to backing material, as by adhesive or stitching, and the material is provided with button holes for securing the pad to the clothing. In an alternative embodiment, a pocket is permanently or detachably secured to the clothing and the pad is located in the pocket. The ability to remove the pad facilitates laundering and broadens the choice of materials that can be used.

Canada Patent Number CA 2 219 826

Inventor: Karen R. Manfre

Issued: May 25, 1998

A multi-compartment, modular jacket includes a vest which has a vest front panel, a vest rear panel, a pair of armholes and a means for opening the vest. A plurality of pockets covers the outer surface of the vest. The vest has a means for releasably attaching a pair of detachable sleeves to the pair of armholes. The inner jacket has a front panel, a rear panel, a pair of sleeves and a means for opening the inner jacket. The exterior surface of the rear panel has a pouch. A plurality of pockets covers the pouch and the exterior surface. The inner jacket has a collar which has a means for containing a collapsible hood. A first composite jacket is formed by fastening the vest to the inner jacket. The first composite jacket has an outside surface which is the exterior surface and an inside surface which is the outer surface. The outer jacket has a jacket front panel, a jacket rear panel, a first pair of sleeves and a means for opening the outer jacket. A third plurality of pockets cover the external and the internal surfaces. The outer jacket has a collar which has a removable hood. A second composite jacket is formed via a means for enclosingly fastening, which extends around an outer seam of the first composite jacket and of the outer jacket. The second composite jacket has an innermost surface which is the outer surface and an outermost surface which is the external surface.

While these pockets may be suitable for the purposes for which they were designed, they would not be as suitable for the purposes of the present invention, as hereinafter described.

SUMMARY OF THE PRESENT INVENTION

The present invention provides a display frame that is attachable and detachable from apparel or portable article such as pocketbook having means for inserting a personalized placard, such as a picture, indicia or graphic creating a Freedom of Speech Frame (F.O.S.). This F.O.S. trend idea allows consumers or companies to use it either for personal or commercial use. It gives them an easily mobile, portable frame that can be removed as an accessory item worn with their own clothing that gives an individual easy access within the frame so they can display, advertise anything they so desire and want to share publicly. This F.O.S. frame is made of clear plastic or clear plastic-matte finish with a border that resembles a picture frame that varies with a special fabric that is attached, either being sewn, or with Hook and loop, snaps, buttons or zippers so that the item which is placed inside this frame is secured and not able to slide, as well as being easily viewed through the plastic-like sleeve. This frame permits freedom of expression within the limits of the law to anyone who wishes to wear it. The user can alter and change the item in the frame as often and as conveniently to reflect his own interest. This new frame allows individuals or companies to advertise or display temporarily, as they wish, but still keep their own personal taste of apparel or clothing which reflects their own personality. It allows individuals or companies to alter or to recycle the messages or to display items. This will avoid waste and avoid outdated items that are no longer of interest. Due to our technological computer driven society, the display frame permits individuals or companies to utilize their skills and be their own advertiser maker thus being current and up to date with the times on a day to day basis. This idea allows one to have more control of printed material worn on one's own body. This idea not only saves the individual money by not having to buy, for example multiple T-shirts or garments one wants displayed on oneself. It also allows the messages or printed material to be more intricate, tasteful and professional since there are no limitations. Freedom of expression, one of our fundamental American rights, will be enhanced by this product since each individual will decide the words and pictures that are to be displayed.

Every American will have the responsibility to know and understand the current "freedom of speech laws" as they apply to the display. This F.O.S. Trend item has many uses such as famous quotes, personal sayings in words, school clubs, sports or celebrity photos, school sports teams, anniversary photos for celebrations, birthday party celebrations and holidays. For example, for St. Patrick's Day one can wear an Irish Flag or show photographs of oneself or family members in Ireland or display "one's own pet" in a green leprechaun hat. Non-profit organizations, conventions, corporate training or artists who want to show their own art work through photos, photographers, or entrepreneurs can advertise their own business. Individuals can show political support for candidates or views on specific issues, positive affirmations, poems, personal photos of loved ones, family or family reunions, vacations, music or movie related items, pet photos, spouse, boyfriend, girlfriend, blog articles legal to print, computer frames with chips that display slide shows, display cartoons, jokes, and comic book related paraphernalia. The uses are endless based on one's interest. This idea will be marketed to men, women, children over 6 years of age, as well as any business or corporation that wants to display a message or anyone who wishes to advertise. The F.O.S. frame will be displayed within an accessory apparel that uses elastic or webbing or straps with suspender clips with plastic inserts, Hook and loop, zippers, sateen fabric, or a fabric design used for a frame style, as well as clear plastic or clear plastic-matte finish with certain items sewn to various parts, if required for personal or commercial use.

A primary object of the present invention is to provide a display frame that is attachable and detachable from an article of apparel.

Another object of the present invention is to provide a display frame that is attachable and detachable from a carriable article.

Yet another object of the present invention is to provide a display frame having a first fastener member forming an integral part therewith and a mating fastener member attached to said apparel forming an integral part therewith whereby said display from is attachable and removable.

Still yet another object of the present invention is to provide a transparent or translucent portion for exhibiting a user desired graphic, picture or indicia therefrom.

Another object of the present invention is to provide a display frame having a border encompassing the display portion forming a frame for said display portion and means of attachment for said fastening elements.

Yet another object of the present invention is to provide said display frame with at least one side that is releasably sealable whereby said display item can be inserted and secured therein.

Additional objects of the present invention will appear as the description proceeds.

The present invention overcomes the shortcomings of the prior art by providing a garment display frame that provides apparel with at least one display frame releasably incorporated into said apparel where the apparel has a part of a mating pair of fasteners and the display frame has the other part. The display frame has a border mounted to the edge of the display frame with a plastic transparent or translucent receptacle bound thereby having a pocket so that the user can insert a visual display of their choosing therein. Also, the apparel display frame has a receptacle that can be incorporated into any garment so that a user can selectively insert any picture, image, message, graphic or artwork as desired. The garment has a first part of a mating fastener while the display frame has the second part incorporated therein whereby the display frame can be removed prior to washing the garment. As illustrated, the garment has at least one display frame of any shape thereon that can occur on any part of the garment forming an integral part therewith.

The foregoing and other objects and advantages will appear from the description to follow. In the description, reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
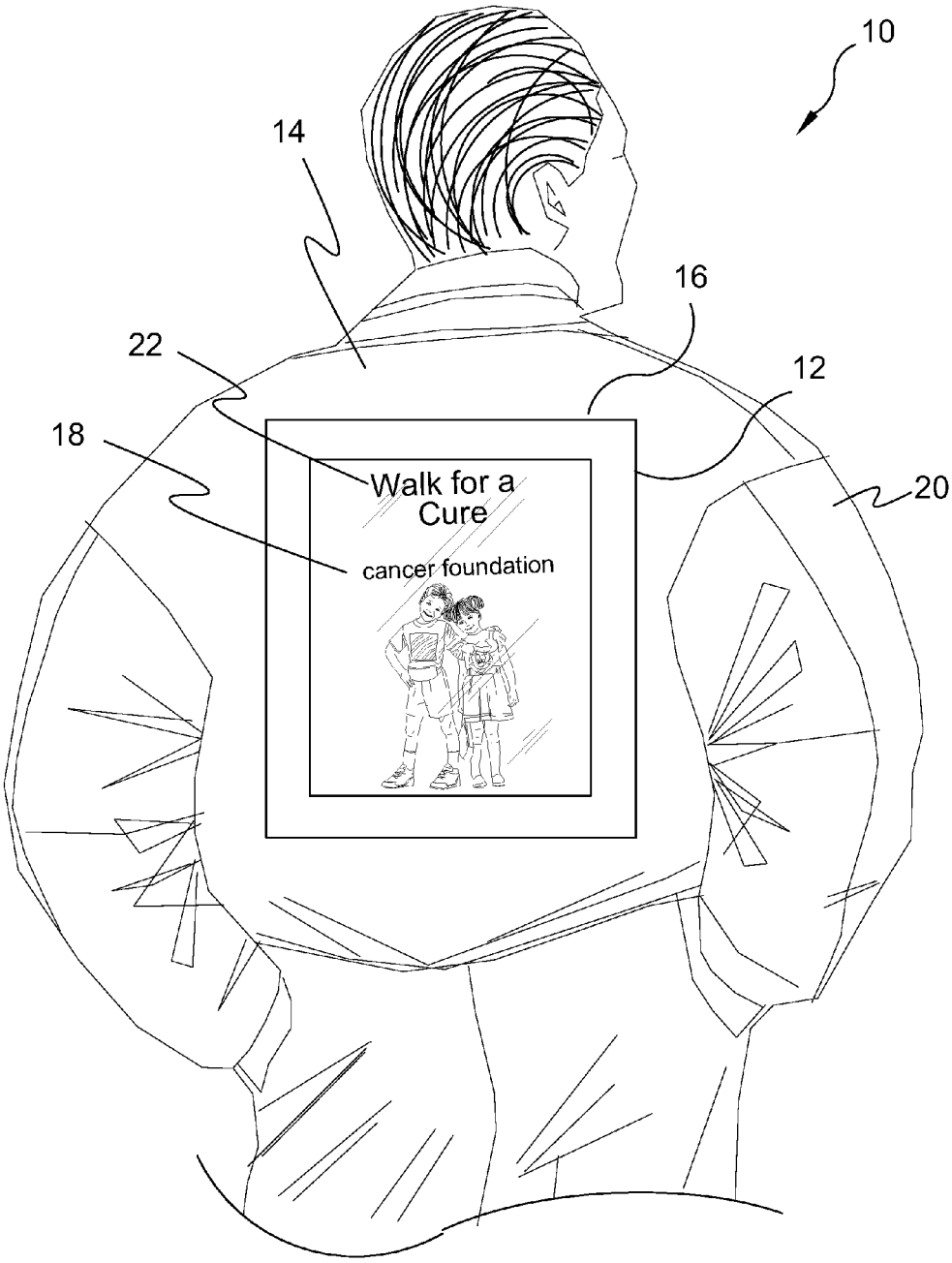
FIG. 1 is an illustrative view of the garment display frame of the present invention in use.

Turning now descriptively to the drawings, in which similar reference characters denote similar elements throughout the several views, the figures illustrate the Apparel Attachable Detachable Display Frame of the present invention. With regard to the reference numerals used, the following numbering is used throughout the various drawing figures.

10 attachable/detachable garment display frame
12 garment display frame
14 apparel/garment
16 frame border
18 plastic window
20 user
22 visual display item
24 receptacle
26 fastener element
28 shirt pocket
30 backing of 12
32 stitching
34 access opening
36 closure fastener for 34
38 hook and loop
40 jacket
42 snap
44 zipper
46 button
48 button hole
50 fastener reinforcement

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

FIG. 1 is an illustrative view of the garment display frame of the present invention 10 in use. The present invention 10 provides apparel 14 with at least one display frame 12 releasably incorporated therein with mating fastener elements on the apparel 14 and the display frame 12. The display frame 12 has a border 16 mounted to the edge with a transparent plastic window 18 covering a pocket so that the user 20 can insert a visual display item 22 of their choosing therein.

Figure 2:
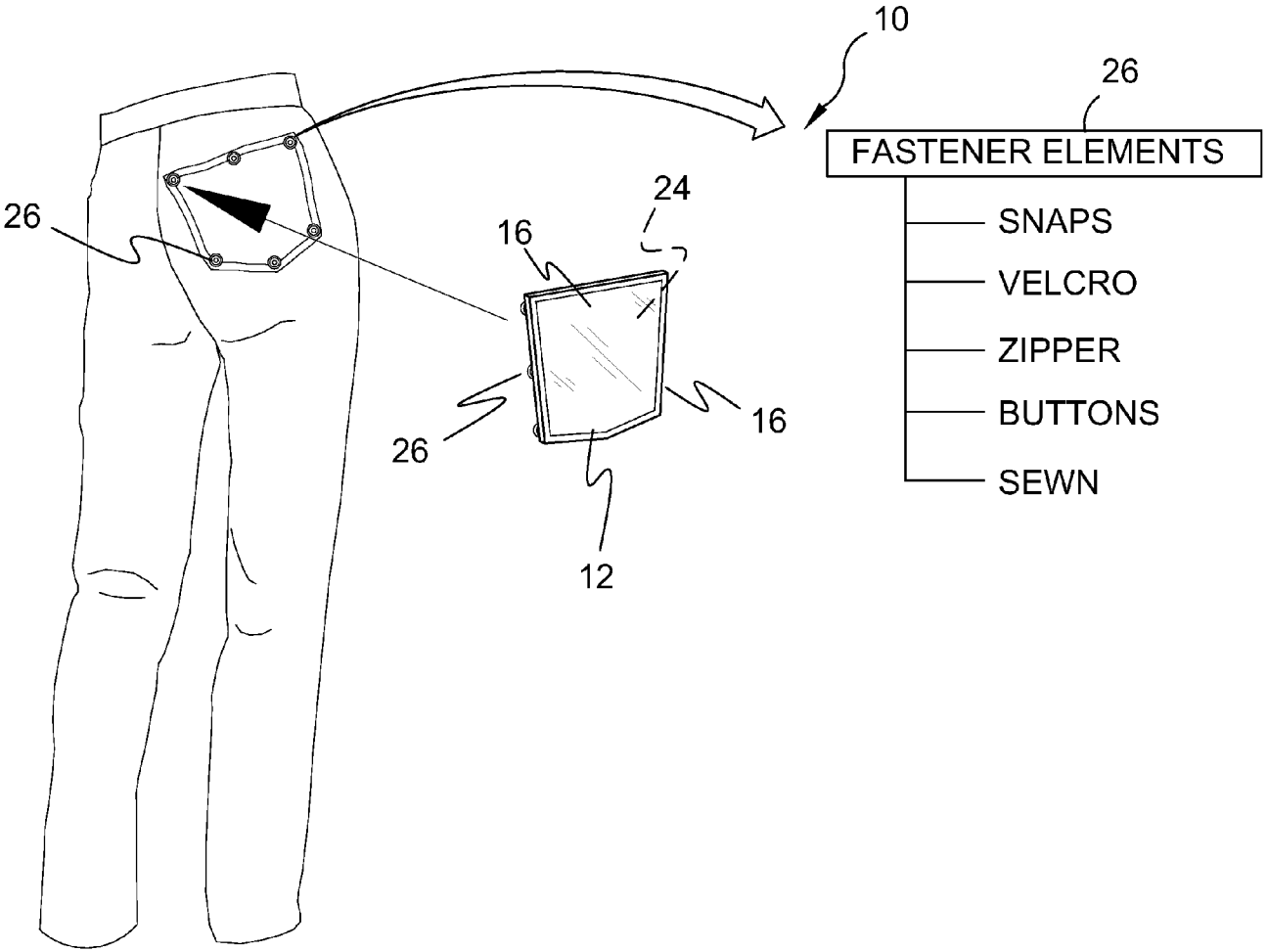
FIG. 2 is an illustrated view of the display frame attachable to dungarees.

FIG. 2 is an illustrated view of the display frame 12 attachable to dungaree apparel 14. The apparel display frame 12 has a frame border 16 and a receptacle 24 behind the plastic window 18 so that a user can selectively insert any picture, image, message, graphic or artword as desired. The apparel 14 and display frame 12 have mating fastener elements 26 whereby the display frame 12 can be removed prior to washing the apparel 14. As illustrated the apparel 14 has at least one display frame 12 of any shape thereon that can occur on any part of the apparel 14 forming an integral part therewith.

Figure 3:
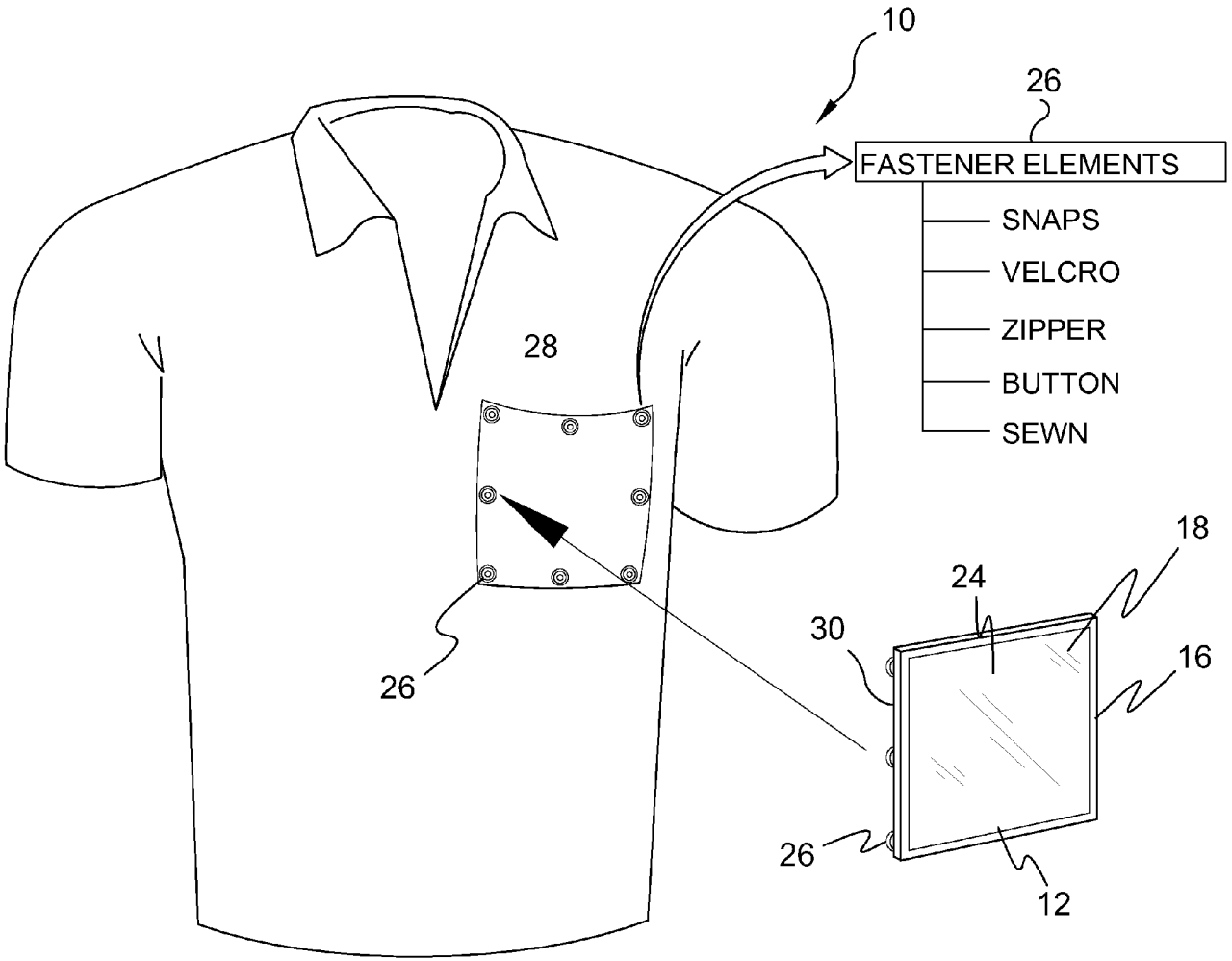
FIG. 3 is an illustrative view of another garment having a display frame positioned on a shirt pocket.

FIG. 3 is an illustrative view of the present invention 10 having a display frame 12 positioned on a shirt pocket 28. The garment display frame 12 is comprised of a transparent or translucent window 18 bonded on three edges to a backing 30 forming a receptacle 24 with a border 16 therearound having the mating fastener elements 26 attached thereto. The backing 30 formed of similar material or a cloth material such as satin or other fabric.

Figure 4:
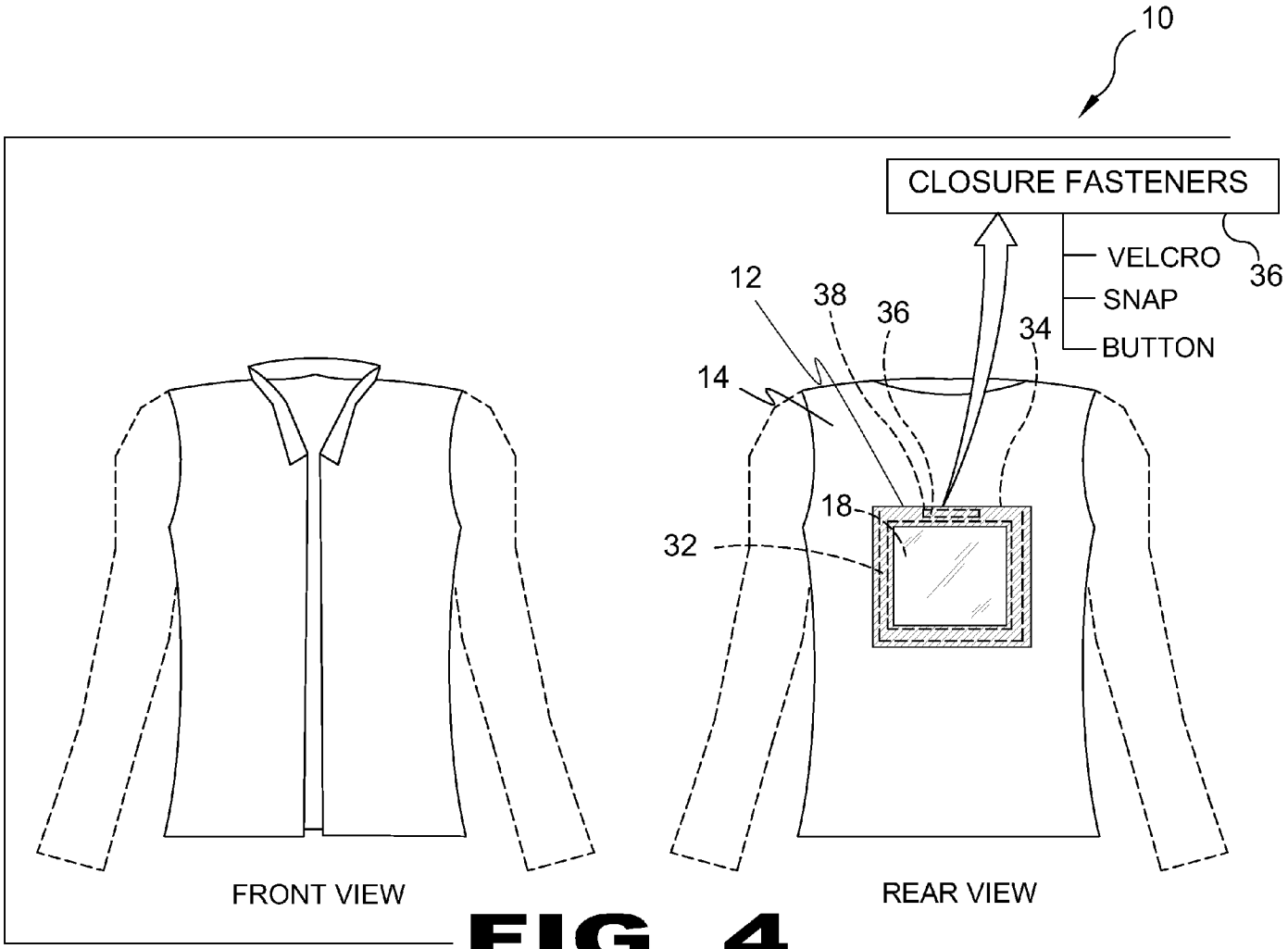
FIG. 4 is an illustrative view of a garment and display frame of the present invention.

FIG. 4 is an illustrative view of an apparel garment 14 and display frame 12 of the present invention 10. Shown is an apparel garment 14 having the stitched 32 display frame 12 peripherally bounding window 18 with an access opening 34 forming closure for the displayed item. The closure fastener 36 for the access opening 34 is shown as hook and loop 38 but is selectable from the group of snap, hook and loop, zipper and button. The present invention 10 provides that a plurality of the aforementioned fasteners can be mixed and matched and is not limited to a single fastener type for a garment. The apparel can be with or without sleeves, vest style, shirt, pants or jacket.

Figure 4A:
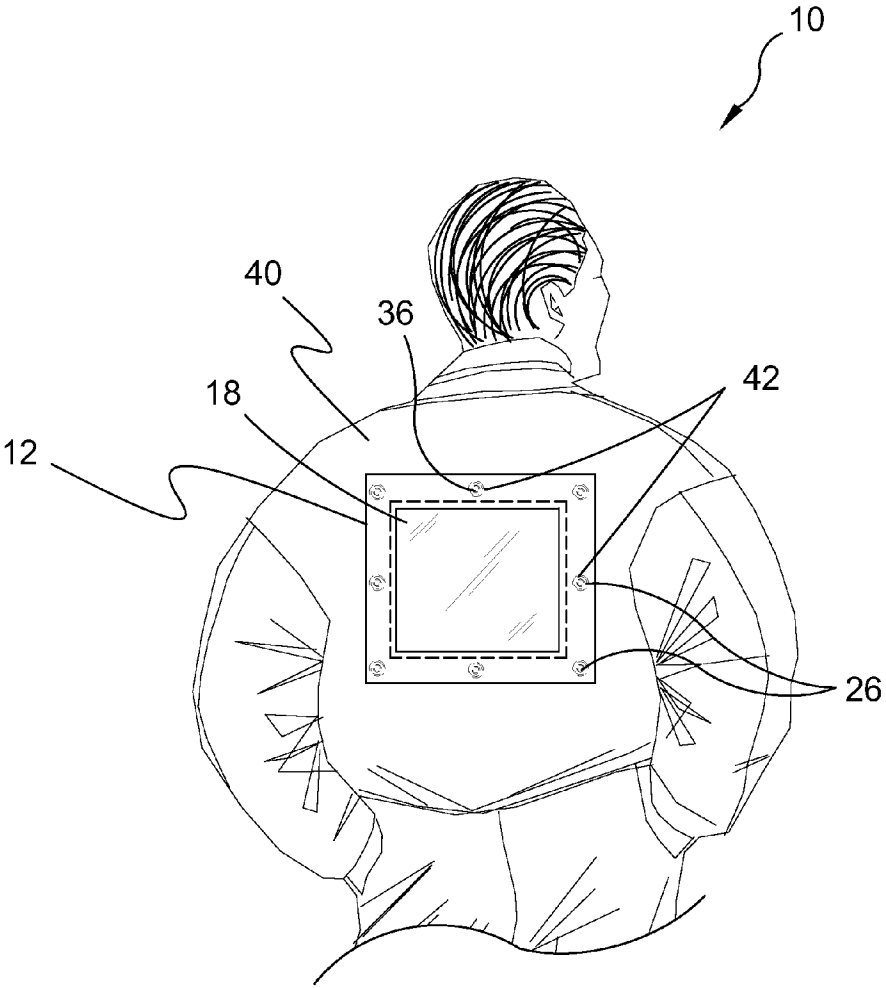
FIG. 4A is an illustrative view of a garment and display frame of the present invention.

FIG. 4A is an illustrative view of a jacket 40 and display frame 12 of the present invention 10. Shown are the fastener elements 26 being snaps 42 so the display frame 12 having window 18 can be removed prior to washing. The closure fastener 36 for the receptacle is shown as a snap 42 but is selectable from the group of snap, Hook and loop, zipper and button.

Figure 4B:
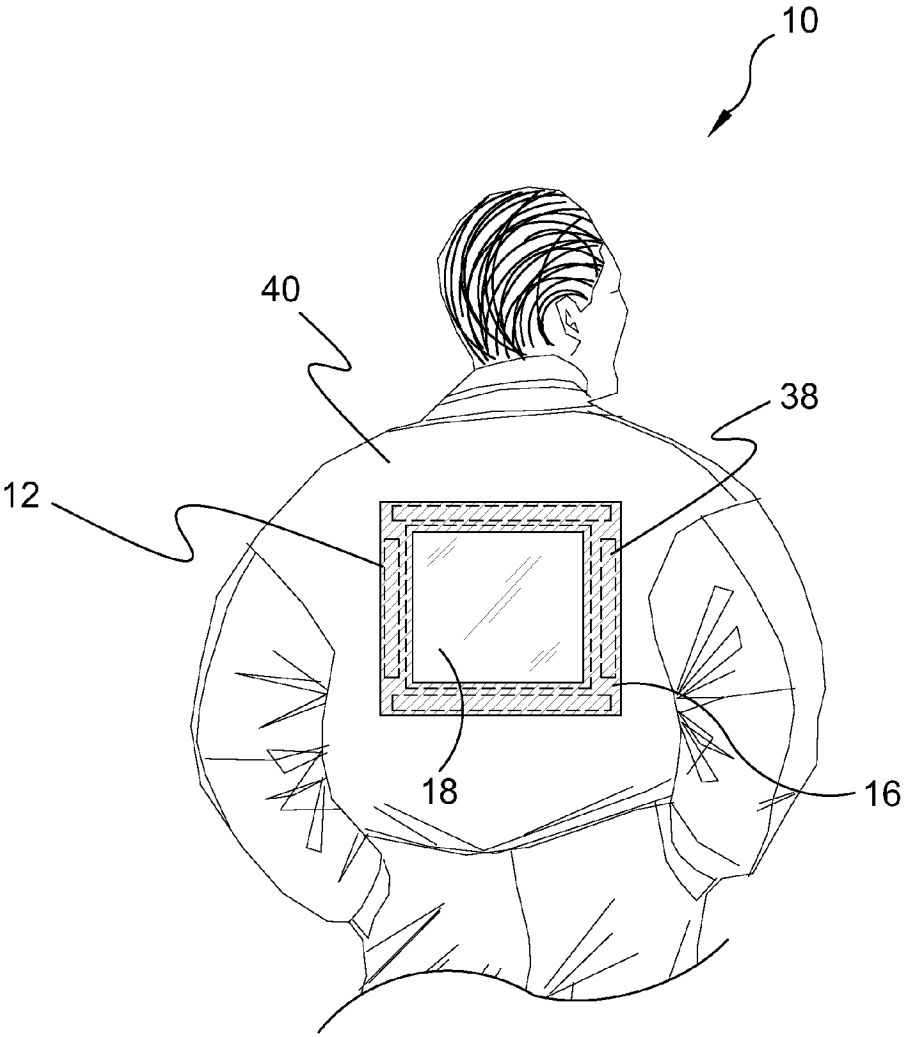
FIG. 4B is an illustrative view of a garment and display frame of the present invention.

FIG. 4B is an illustrative view of a jacket 40 and display frame 12 of the present invention 10. Shown is the jacket 40 having the display frame 12 bounding window 18 releasably attached to jacket 40 having the fastener elements 26 being engagable lengths of hook and loop 38 fastened to jacket 40 with the complementary hook and loop 38 members fastened to the display frame border 16 thereby removable prior to washing.

Figure 4C:
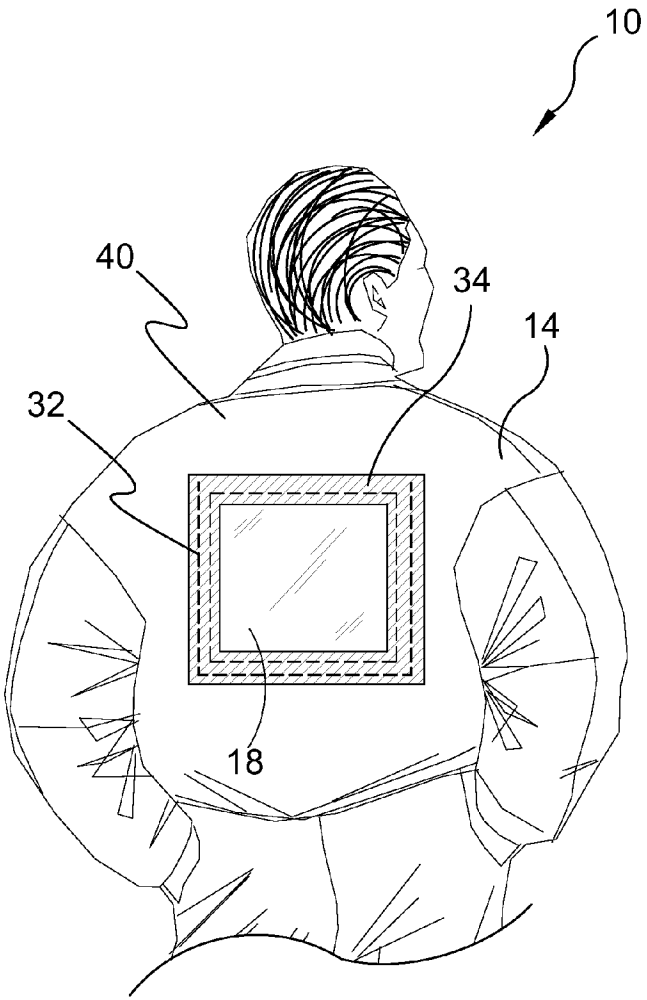
FIG. 4C is an illustrative view of a garment and display frame of the present invention.

FIG. 4C is an illustrative view of the apparel 14 being a jacket 40 with the windowed 18 display frame 12 of the present invention 10. Shown is the apparel 14 having the display frame 12 stitched 32 thereon with an access opening 34 for inserting the displayed item.

Figure 5:
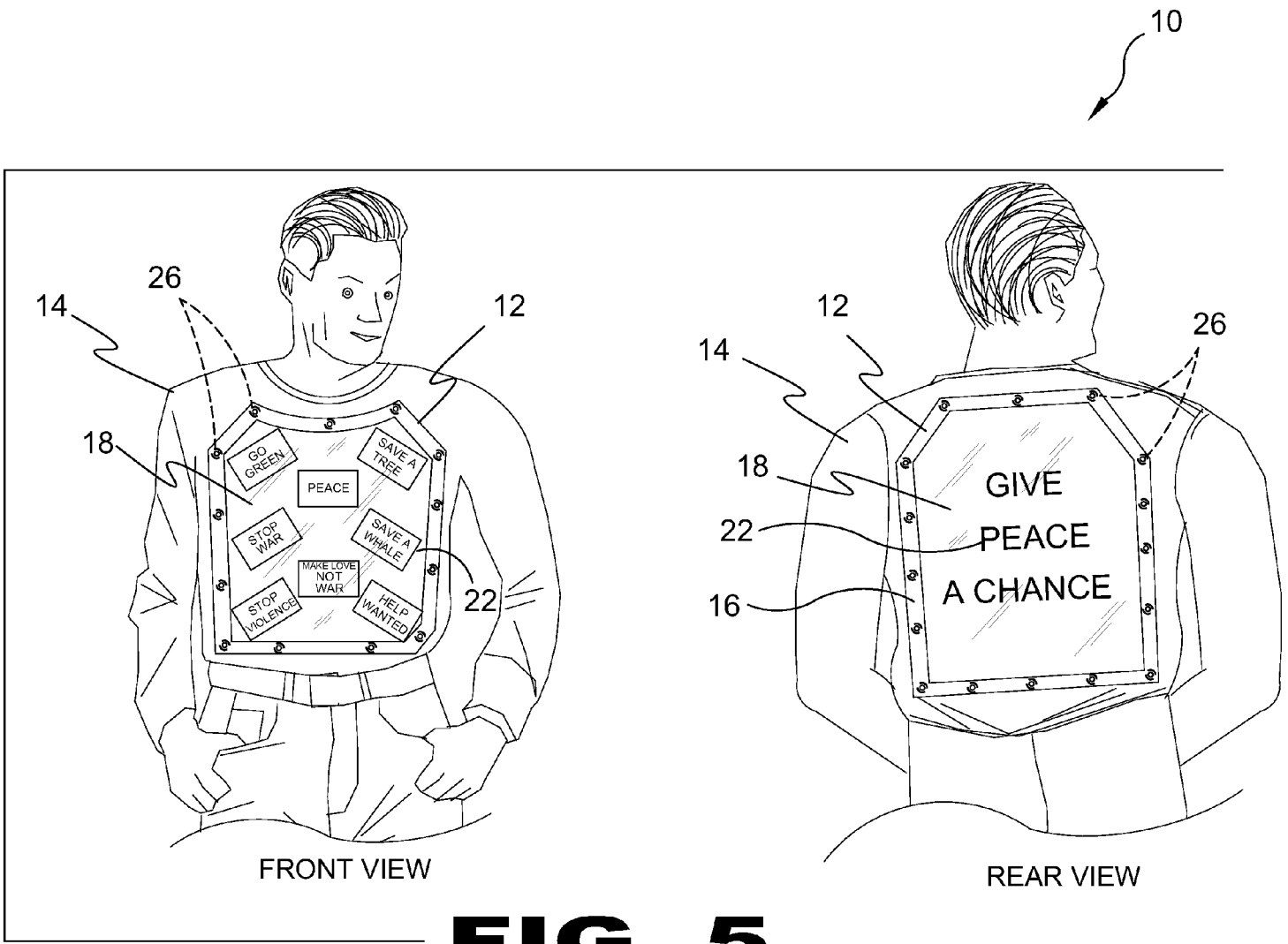
FIG. 5 is an illustrative view of a garment and a plurality of display frames.

FIG. 5 is an illustrative view of an apparel 14 item having a plurality of display frames 12. The present invention 10 provides that the apparel 14 may have a plurality of display frames 12 of various shapes using a plurality of fastening elements 26 taken from the group of snap, Hook and loop, zipper, button and sewn. The present invention 10 provides apparel 14 with at least one display frame 12 releasably incorporated into said apparel 14 where the apparel 14 has a part of a mating pair of fastener elements 26 and the display frame 12 has the other part. The display frame 12 has a border 16 mounted to the edge of the display frame 12 with a plastic transparent or translucent window 18 bound thereby having a pocket so that the user can insert a visual display 22 of their choice.

Figure 6:
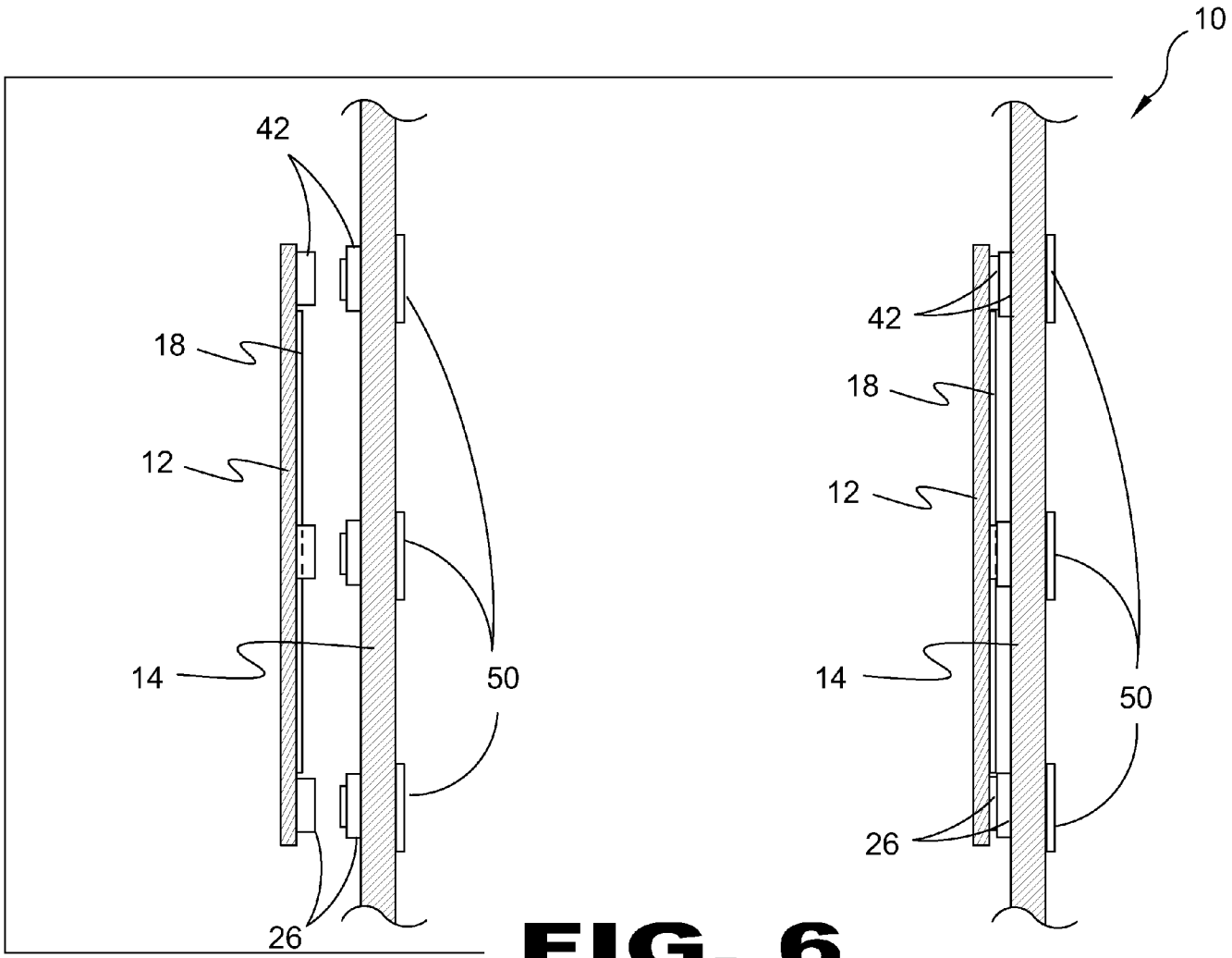
FIG. 6 is a sectional view of the present invention.

FIG. 6 is a sectional view of the present invention 10. Shown is the display frame 12 having window 18 mounted to an apparel 14 item having snap 42 fastener elements 26 fixedly attached to frame border 16 for attaching and detaching the garment display frame 12 as an accessory item to apparel 14. Also provided is fastener reinforcement 50 that may be required depending on the type of fastener or the type of garment material. The user inserts a displayable item within the frame receptacle.

Figure 7:
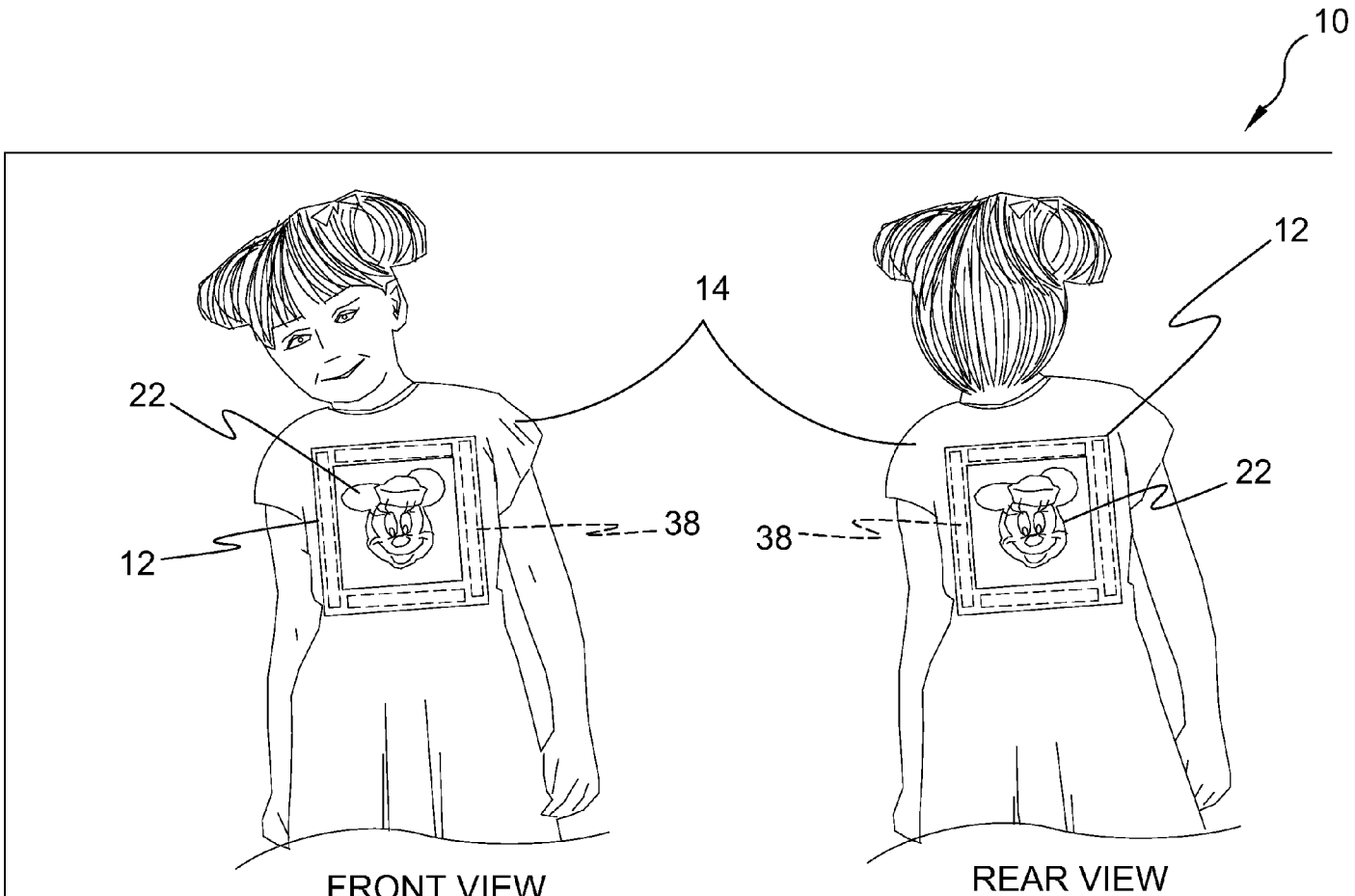
FIG. 7 is an illustrative view of the garment display frame.

FIG. 7 is an illustrative view of the garment display frame 12. Shown is the garment display frame 12 of the present invention 10 comprising a garment using hook and loop 38 wherein the apparel 14 has a first mating fastening member forming an integral part therewith and the display frame has a mating fastening member whereby the display frame 12 can be selectively attached to the garment with the display having a receptacle for receiving a user selected visual display 22 therein.

Figure 8:
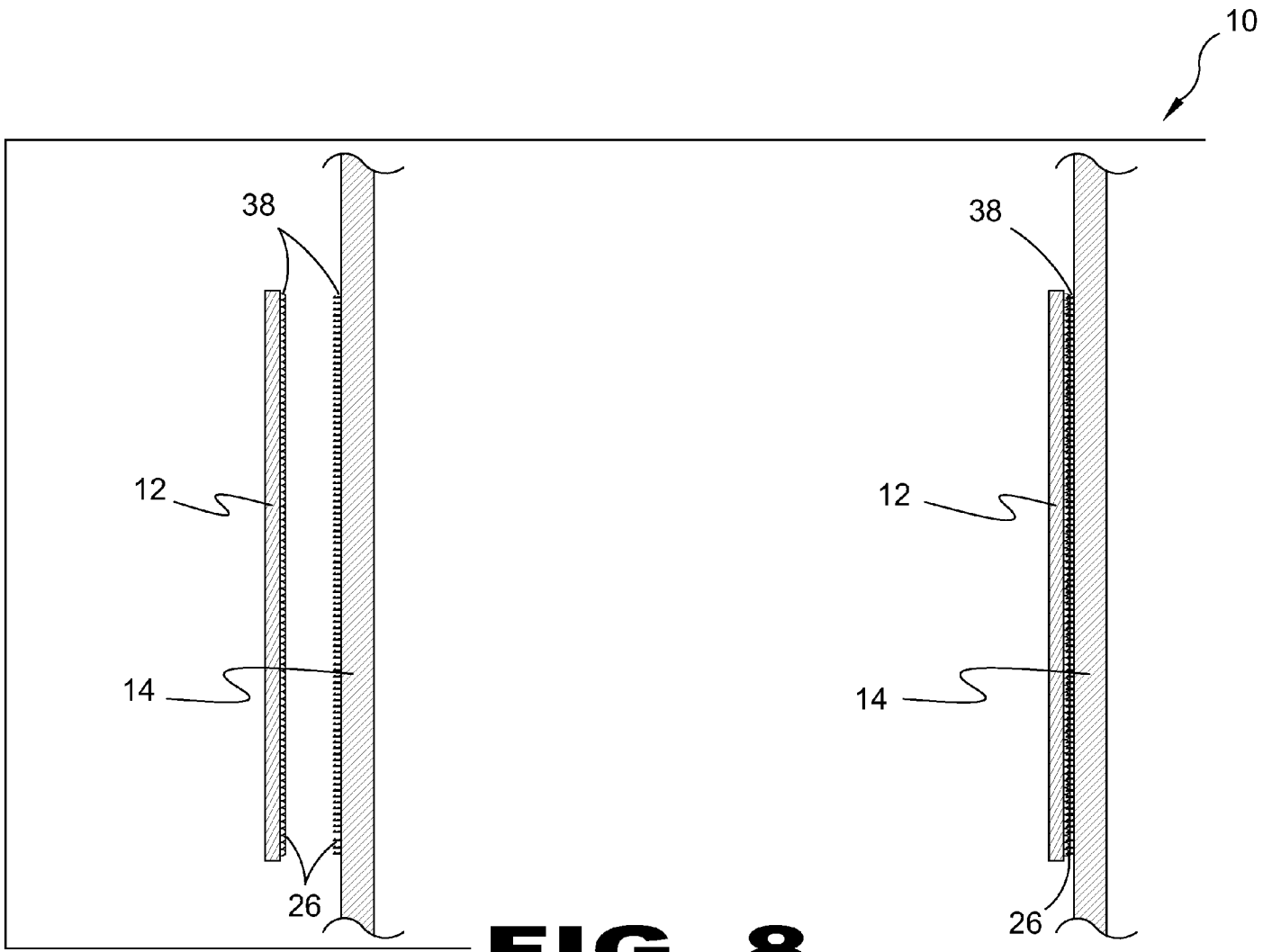
FIG. 8 is an illustrative view of an additional fastener for the garment display frame.

FIG. 8 is an illustrative view of a fastener element 26 for the garment display frame 12. Shown is an additional means for fastening the garment display frame 12 of the present invention 10 comprising lengths of hook and loop 38 incorporated onto the apparel 14 with the display frame 12 having the mating hook and loop 38 member whereby the display frame 12 can be selectively mounted and dismounted from the apparel 14 as desired. The display frame 12 has a receptacle for receiving a user selected display therein.

Figure 9:
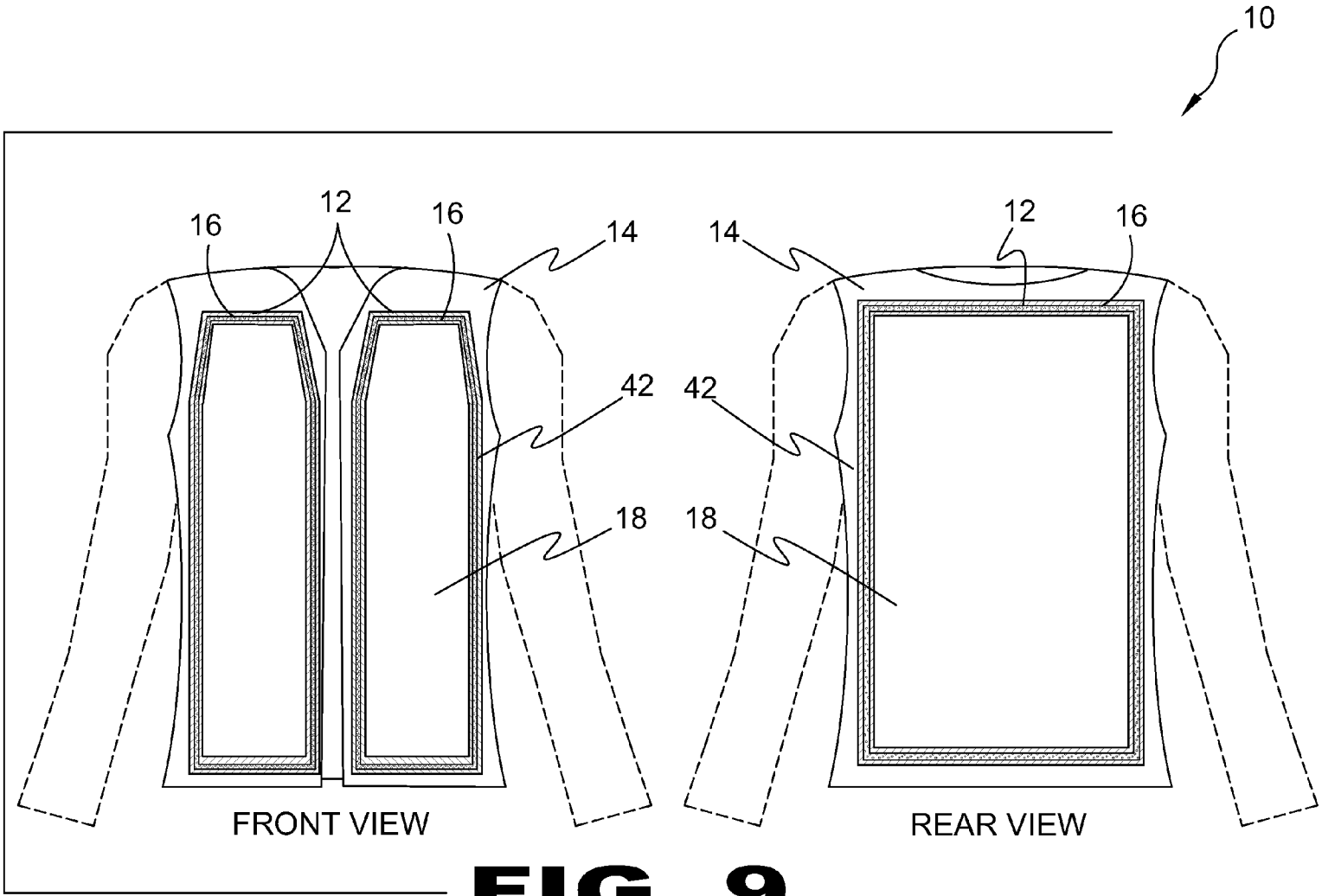
FIG. 9 is an illustrative view of a garment and a plurality of zippered display frames.

FIG. 9 is an illustrative view of a garment 14 and a plurality of zippered display frames 12. The present invention 10 provides that a garment 14 may have a plurality of display frames 12 of various shapes using a plurality of fastening elements 26 taken from the group of snap, Hook and loop, zipper 42, button and sewn. The present invention 10 provides apparel 14 with at least one display frame 12 releasably incorporated into said apparel 14 where the apparel 14 has a part of a mating pair of fastener elements 26 and the display frame 12 has the other part. The display frame 12 has a border 16 mounted to the edge of the display frame 12 with a plastic transparent or translucent window 18 bound thereby having a pocket so that the user can insert a visual display.

Figure 9A:
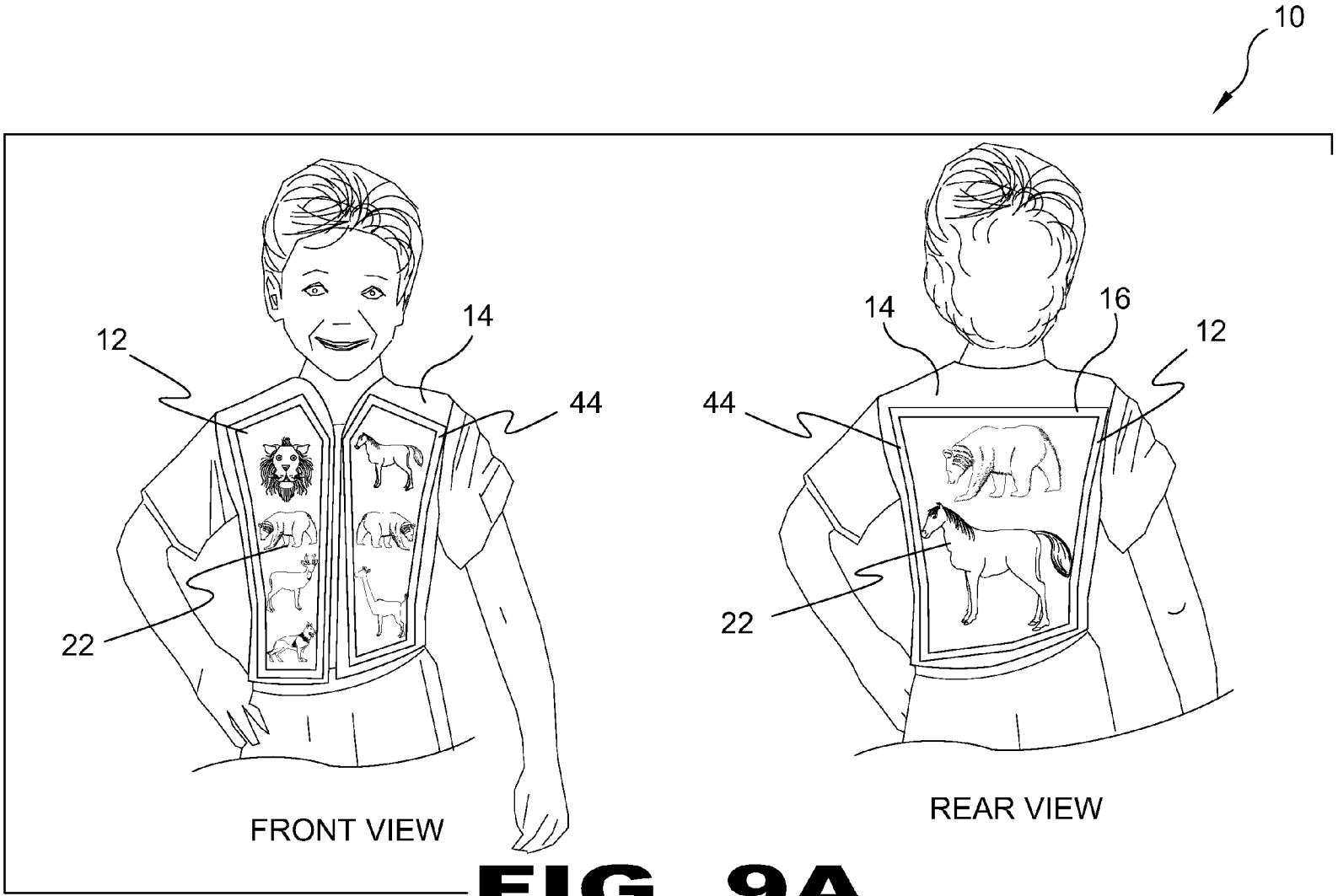
FIG. 9A is an illustrative view of a garment and a plurality of zippered display frames.

FIG. 9A is an illustrative view of a garment 14 and a plurality of zippered display frames 12. The present invention 10 provides that a garment 14 may have a plurality of display frames 12 of various shapes using a plurality of fastening elements 26 taken from the group of snap, Hook and loop, zipper 42, button and sewn. The present invention 10 provides apparel 14 with at least one display frame 12 releasably incorporated into said apparel 14 where the apparel 14 has a part of a mating pair of fastener elements 26 and the display frame 12 has the other part. The display frame 12 has a border 16 mounted to the edge of the display frame 12 with a plastic transparent or translucent window 18 bound thereby having a pocket so that the user can insert a visual display 22.

Figure 10:
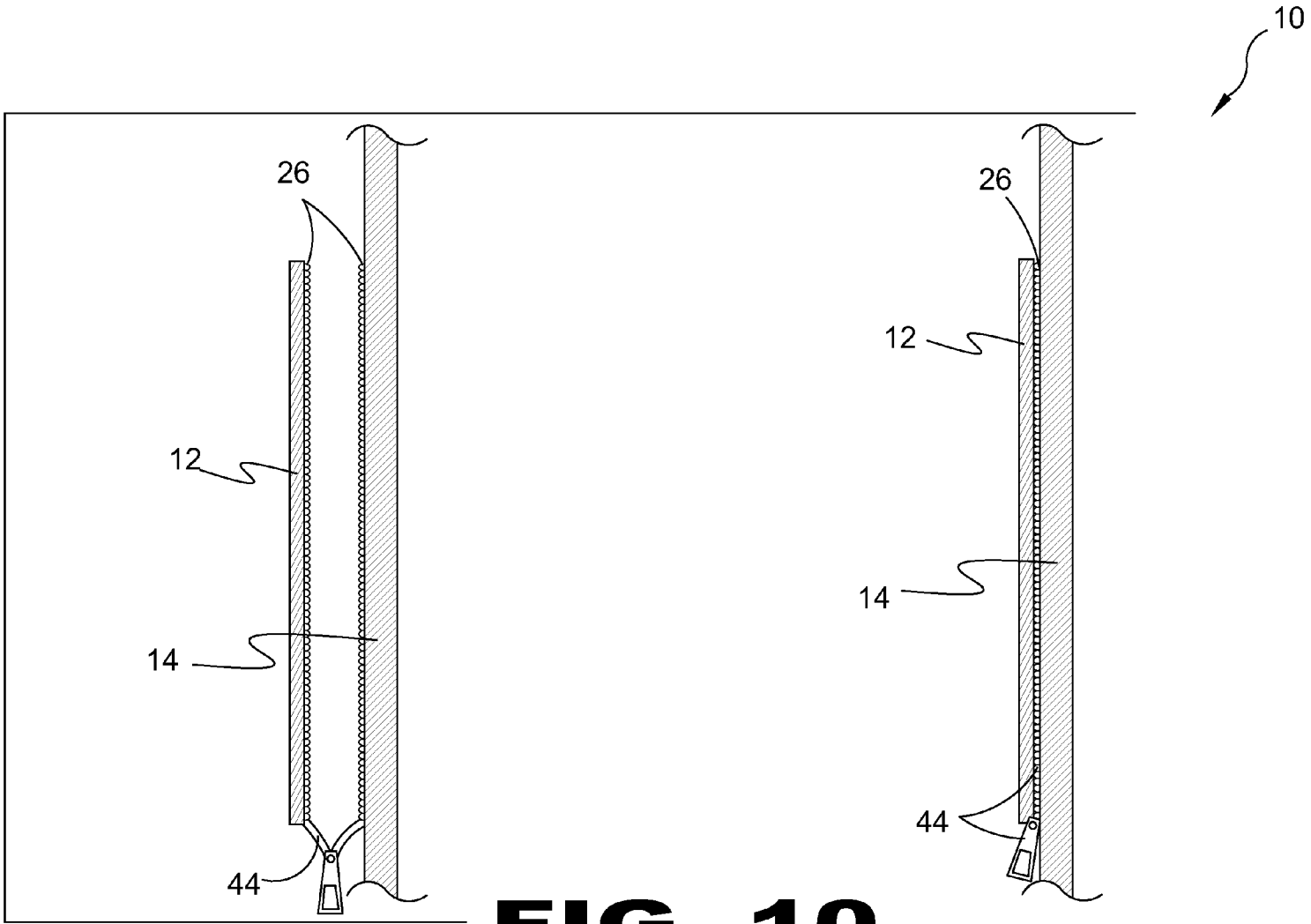
FIG. 10 is an illustrative view of an additional fastener for the garment display frame.

FIG. 10 is an illustrative view of an additional fastener element 26 for the garment display frame 12. Shown is an additional means for fastening the garment display frame 12 of the present invention 10 comprising lengths of zipper 44 incorporated onto the garment 14 with the display frame 12 having the mating zipper 44 track member whereby the display frame 12 can be selectively mounted and dismounted from the garment 14 as desired.

Figure 11:
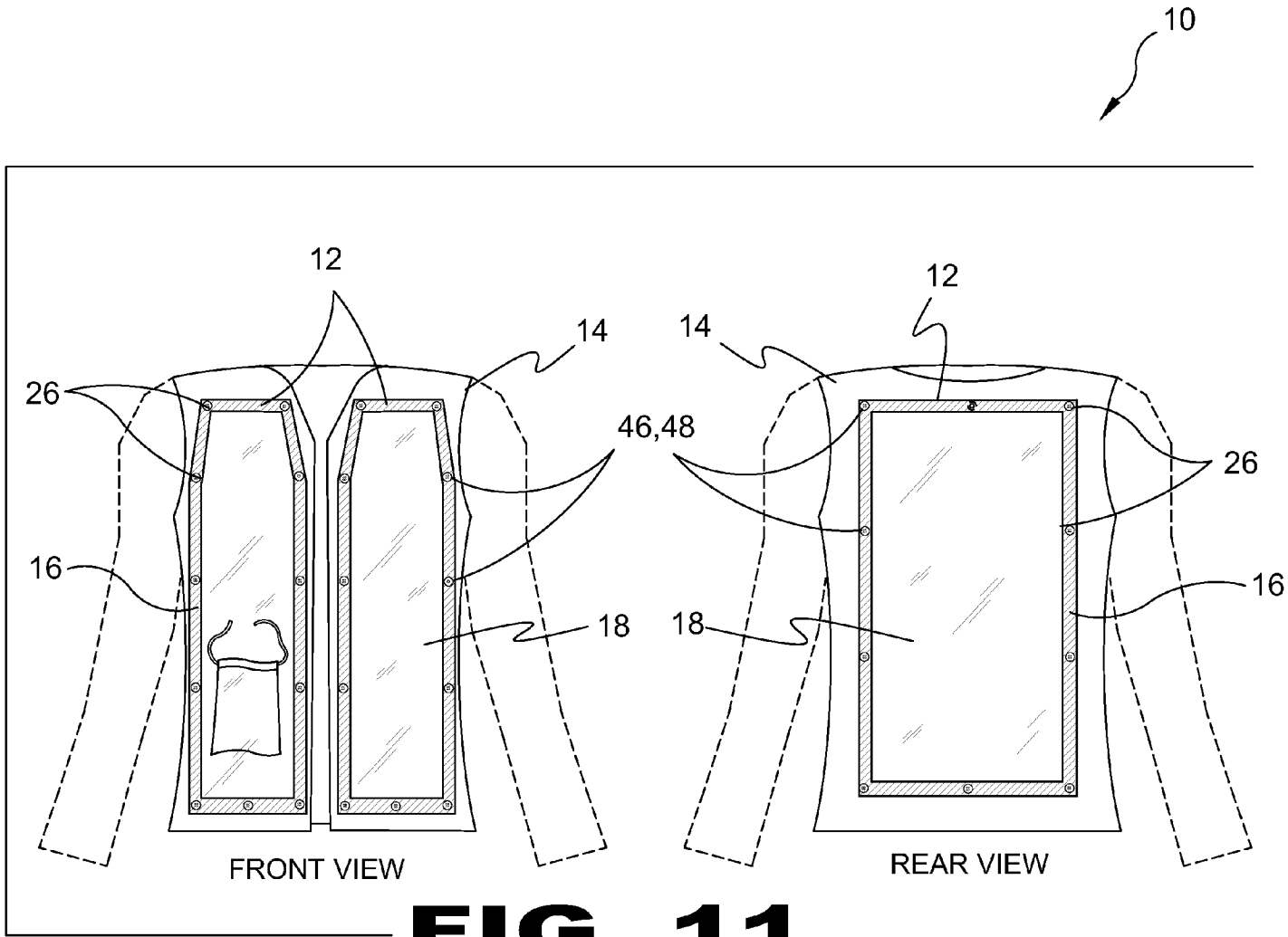
FIG. 11 is an illustrative view of a garment and a plurality of display frames.

FIG. 11 is an illustrative view of a garment 14 and a plurality of display frames 12. The present invention 10 provides that a garment 14 may have a plurality of display frames 12 of various shapes using a plurality of fastening members 26 taken from the group of snap, Hook and loop, zipper, button 46 and sewn. The present invention 10 provides apparel 14 with at least one display frame 12 releasably incorporated into said apparel 14 where the apparel 14 has a plurality of buttons 46 and the display frame 12 has corresponding button holes 48. The display frame 12 has a border 16 mounted to the edge of the display frame 12 with a plastic transparent or translucent window 18 bound thereby having a pocket so that the user can insert a visual display of their choice.

Figure 12:
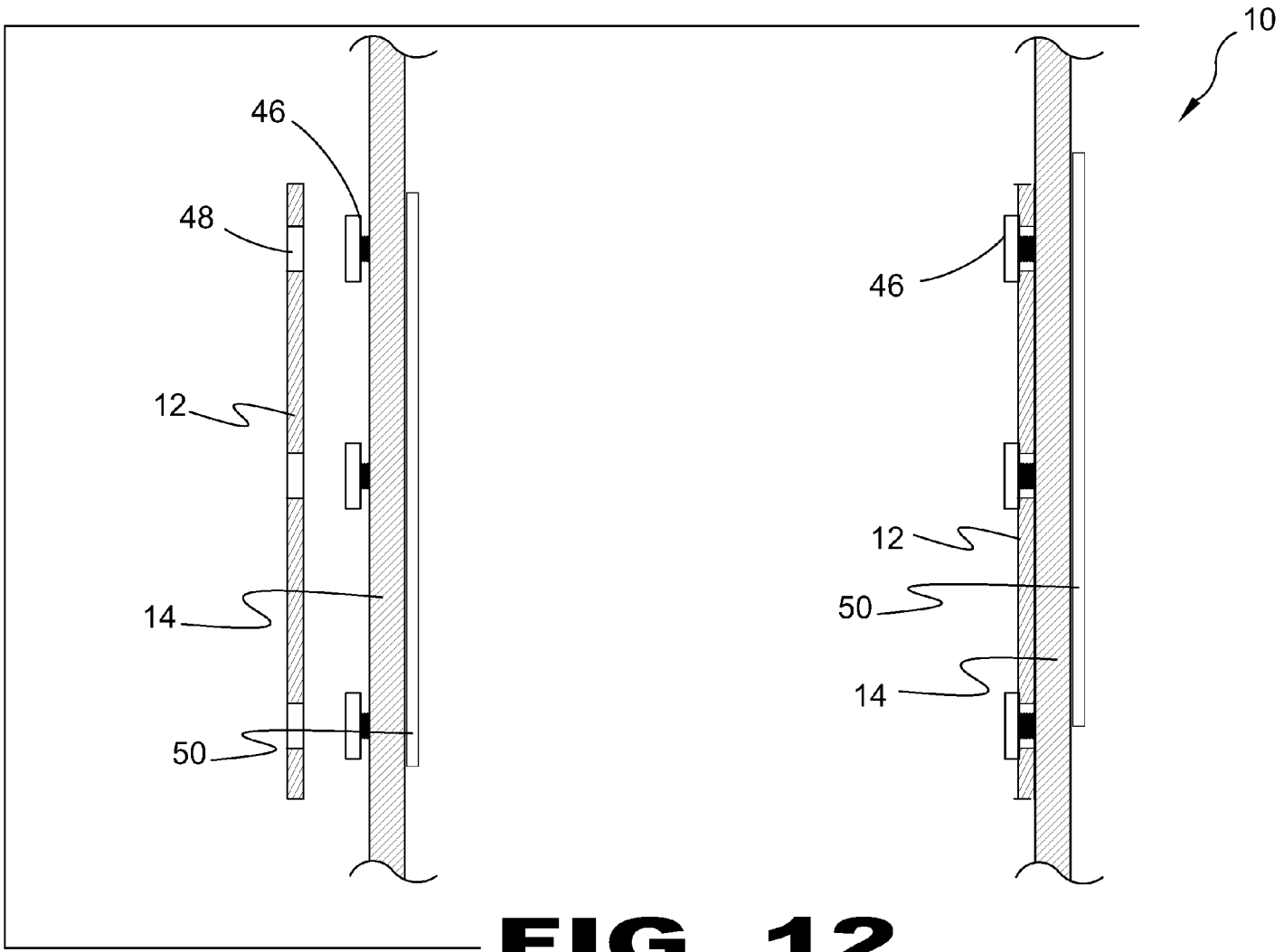
FIG. 12 is a sectional view of the present invention.

FIG. 12 is a sectional view of the present invention 10. Shown is the display frame 12 getting mounted to a garment 14 having buttons 46 and button holes 48 for attaching and detaching the garment display frame 12 as an accessory item to a garment 14. The user inserts a displayable item within the frame receptacle.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

The invention claimed is:

1. A garment display frame comprising:

a) said garment having sleeves, a collar, front and back surfaces, said frame being transparent and removably mounted on a front or back surface of said garment and forming a receptacle on said garment;

b) a window supported by and in contact with said frame exterior to and adjacent said receptacle whereas a visual display item is contained within said receptacle and visible through said window;

c) said frame having a border peripheral to said window, said border having a front surface adjacent to said window and disposed about a periphery of said window and a rear surface opposite said front surface;

d) an access opening providing access to said receptacle;

e) a plurality of fasteners for removably affixing said frame to an outer surface of said garment, each of said plurality of fasteners having a first portion mounted on an outer rear surface of the border, a second portion secured on a front surface of the garment, and a separate reinforcement portion mounted on an inner surface of said garment so as to align with each of said second portions; and f) wherein said plurality of fasteners are selected from the group consisting of snaps, mating hook and loop fasteners, zippers, and buttons.

2. A garment display frame according to claim 1, wherein said window is selected from the group consisting of translucent and transparent material.

3. A garment display frame according to claim 2, wherein said window is clear plastic.

4. A garment display frame according to claim 1, further comprising a closure fastener for securing said access opening.

5. A garment display frame according to claim 4, wherein said closure fastener for said receptacle is selected from the group of snaps, hook and loop, zippers and buttons.

6. A garment display frame according to claim 4, wherein said receptacle is formed by said window bonding on three edges of said frame.

7. A garment display frame according to claim 1, wherein said item of display apparel contains a plurality of said frames.

8. A method of displaying a display item on an item of display apparel comprising the steps:

a) providing an item of display apparel, said apparel having sleeves, a collar, front and back sides, a display frame on a front or back side of said apparel, a receptacle interior to said frame, a transparent window exterior to and adjacent said receptacle, said frame having a border peripheral to said window, said border having a front surface adjacent to and disposed about a periphery of said window and a rear surface opposite said front surface, an access opening providing access to said receptacle, and a plurality of fasteners mounted on said border for removably affixing said frame to said item of apparel, wherein each fastener has a first portion mounted on an outer rear surface of the border, a second portion secured on a front surface of the garment, and a separate reinforcement portion mounted on an inner surface of said garment so as to align with each of said second portions and said plurality of fasteners are selected from the group consisting of snaps, mating hook and loop fasteners, zippers, and buttons;

b) removably affixing said frame to said item of display apparel via said plurality of fasteners; and c) placing a display item in said receptacle so that said display item is viewable through said window.

9. A method of displaying a display item on an item of display apparel according to claim 8, further comprising the step of closing said access opening by means selected from the group consisting of snaps, mating hook and loop fasteners, zippers and buttons.

* * * * *